US010510329B1

(12) United States Patent
Yasuda et al.

(10) Patent No.: US 10,510,329 B1
(45) Date of Patent: Dec. 17, 2019

(54) KEYBOARD APPARATUS

(71) Applicant: YAMAHA CORPORATION, Hamamatsu-shi (JP)

(72) Inventors: Yoshihiko Yasuda, Hamamatsu (JP); Yuji Yamada, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/430,503

(22) Filed: Jun. 4, 2019

(30) Foreign Application Priority Data

Jun. 27, 2018 (JP) ..... 2018-122511

(51) Int. Cl.
*G10H 1/32* (2006.01)
*G10H 1/34* (2006.01)
*G10C 3/12* (2006.01)

(52) U.S. Cl.
CPC ..... *G10H 1/34* (2013.01); *G10C 3/12* (2013.01); *G10H 2220/251* (2013.01)

(58) Field of Classification Search
CPC ..... G10H 1/34; G10H 2220/251; G10C 3/12; G10C 3/02; G10C 3/04
USPC ..... 84/718, 743, 745
See application file for complete search history.

(56) References Cited

U.S. PATENT DOCUMENTS 6,133,517 A * 10/2000 Masubuchi ..... G10C 3/12 84/423 R
7,326,844 B2 * 2/2008 Nishida ..... G10H 1/34 84/423 R
7,425,672 B2 * 9/2008 Haba ..... G10H 1/32 84/177
2008/0163740 A1 * 7/2008 Nonaka ..... G10H 1/34 84/423 R
2019/0035371 A1 * 1/2019 Ichiki ..... G10B 3/12

FOREIGN PATENT DOCUMENTS

JP 5532670 B2 6/2014

* cited by examiner

*Primary Examiner* — Jeffrey Donels
(74) *Attorney, Agent, or Firm* — Rossi, Kimms & McDowell LLP

(57) ABSTRACT

A keyboard apparatus includes a plurality of keys, a frame supporting the plurality of keys arranged in a first direction, a first member, a longitudinal direction of the first member being along the first direction, and a second member including a first section, a second section, and a third section, the first section, the third section, and the second section being arranged in this order in a second direction perpendicular to the first direction, the first section being a plate-shaped member sandwiched between the first member and the frame, the second section being connected to the first member at a position away from the first section, the third section being separated from the first member between the first section and the second section, and a longitudinal direction of the second member being along the first direction.

9 Claims, 8 Drawing Sheets

KEYBOARD APPARATUS

CROSS REFERENCE TO RELATED APPLICATIONS

This application is based upon and claims the benefit of priority from the prior Japanese Patent Application No. 2018-122511, filed on Jun. 27, 2018, the entire contents of which are incorporated herein by reference.

FIELD

The present invention relates to a keyboard apparatus.

BACKGROUND

A keyboard apparatus has a long shape corresponding to the number of keys in a direction in which the keys are arranged. To solve a problem occurring due to such a shape, various structures are applied within a housing. For example, a technique for defining a positional relationship among the components arranged within the housing with high accuracy is disclosed in Japanese Patent No. 5532670.

SUMMARY

According to an aspect of the present invention, there is provided a keyboard apparatus including a plurality of keys, a frame supporting the plurality of keys arranged in a first direction, a first member, a longitudinal direction of the first member being along the first direction, and a second member including a first section, a second section, and a third section, the first section, the third section, and the second section being arranged in this order in a second direction perpendicular to the first direction, the first section being a plate-shaped member sandwiched between the first member and the frame, the second section being connected to the first member at a position away from the first section, the third section being separated from the first member between the first section and the second section, and a longitudinal direction of the second member being along the first direction.

DESCRIPTION OF EMBODIMENTS

Figure 1:
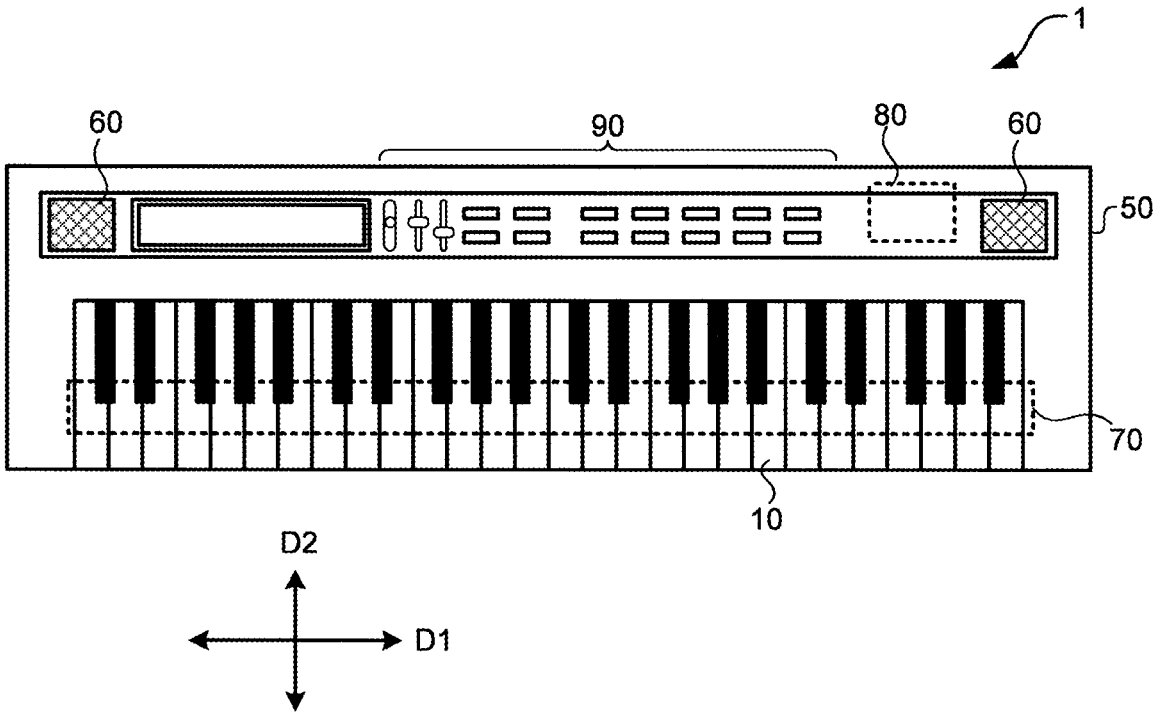
FIG. 1 is a diagram for describing an appearance of a keyboard apparatus according to a first embodiment of the present invention.

A keyboard apparatus according to an embodiment of the present invention will be described in detail below with reference to the drawings.

Embodiments described below are examples of the embodiment of the present invention, and the present invention is not necessarily limited to the embodiments and interpreted. In the drawings referred to in the present embodiment, identical sections or sections having similar functions are respectively assigned identical or similar reference symbols (reference numbers followed by A, B, etc.), and repetitive description may be omitted. A dimensional ratio in the drawings may differ from an actual ratio for convenience of illustration, or some of components may be omitted from the drawings.

First Embodiment

[1. Outline]

In a first embodiment, a keyboard apparatus used as an electronic keyboard instrument will be described. The keyboard apparatus has a shape which is long in one direction, and thus easily twists with its longitudinal direction used as an axis. Since a performance operation causes a force to be applied to a part of the keyboard apparatus, the force may cause torsional deformation of the keyboard apparatus. When the keyboard apparatus is deformed by the performance operation, a feeling of a performance is also affected. Therefore, for example, in the keyboard apparatus, a reinforcement member is arranged within the housing. By increasing the rigidity of the entire housing with the reinforcement member, the deformation of the keyboard apparatus is suppressed. However, such an attempt to increase the rigidity of a housing to suppress the deformation of the keyboard apparatus causes the weight of the keyboard apparatus to increase. One of purposes of the present invention is to suppress the increase of the weight of the keyboard apparatus while increasing the rigidity of the keyboard apparatus. Details of the keyboard apparatus will be described below.

[2. Appearance of Keyboard Apparatus]

FIG. 1 is a diagram illustrating an appearance of a keyboard apparatus 1 according to the first embodiment of the present invention. The keyboard apparatus 1 is an electronic keyboard instrument, and is an electronic piano in this example. The keyboard apparatus 1 includes keys 10, a housing 50, a speaker 60, a sound source unit 80, and an operation unit 90. The plurality of keys 10 are arranged side by side in one direction. A direction in which the plurality of keys 10 are arranged (a scale direction) is referred to as a first direction D1. A direction perpendicular to the first direction D1 is referred to as a second direction D2. When the keyboard apparatus 1 is viewed from above, a longitudinal direction of the keys 10 is the same as the second direction D2. A direction perpendicular to both the first direction D1 and the second direction D2 is referred to as a third direction D3 (see FIG. 3). The third direction D3 corresponds to a substantially vertical direction (an up-and-down direction) when the keyboard apparatus 1 is flatly placed. That is, each of the first direction D1 and the second direction D2 is a horizontal direction with the keyboard apparatus 1 flatly placed. In the following description, the side on which a player exists with respect to the keyboard apparatus 1 (the side on which the keys 10 exist with respect to the housing 50) is referred to as a front side, and the opposite side to the player is referred to as a rear side. Accordingly, as viewed from the player, the first direction D1 of the keyboard apparatus 1 horizontally placed corresponds to a right-to-left direction, and the second direction D2 corresponds to a front-to-back direction.

The keys 10 can rotate with respect to the housing 50. A state where the longitudinal direction of the keys 10 and the second direction D2 match each other is included in a rotation range of the keys 10. In the housing 50, the speaker 60, the key position detection unit 70, the sound source unit 80, and the operation unit 90 are arranged. A user operates the keys 10, and a sound is produced from the speaker 60 by a sound producing function in the keyboard apparatus 1. The operation unit 90 includes devices such as an operation button, a touch sensor, and a slider, and receives an instruction to change a type (a tone) and a volume of a sound to be produced and outputs a signal corresponding to an input operation to the sound source unit 80. The keyboard apparatus 1 may include an interface for inputting and outputting a signal to and from an external apparatus. Examples of the interface include a terminal for outputting a sound signal to the external apparatus and a cable connection terminal for transmitting and receiving MIDI (musical instrument digital interface) data.

[3. Sound Producing Function]

Figure 2:
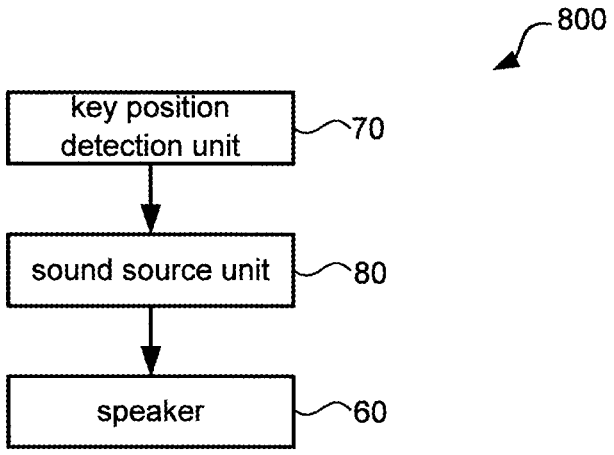
FIG. 2 is a diagram for describing a sound producing function in the keyboard apparatus according to the first embodiment of the present invention.

FIG. 2 is a diagram for describing the sound producing function 800 in the keyboard apparatus 1 according to the first embodiment of the present invention. The sound producing function 800 includes the key position detection unit 70, the sound source unit 80, and the speaker 60. The key position detection unit 70 includes sensors respectively arranged for the plurality of keys 10. The sensor corresponding to one of the keys 10 detects a position (a pressing position) in the rotation range of the key 10. The key position detection unit 70 outputs to the sound source unit 80 information for specifying one of the plurality of keys 10 and information corresponding to the pressing position of the specified key 10.

The sound source unit 80 is a signal processing circuit which generates a sound signal in response to a performance operation onto the keys 10. More specifically, the sound source unit 80 generates a sound signal based on the information outputted from the key position detection unit 70, and outputs the generated sound signal to the speaker 60. The speaker 60 amplifies and outputs the sound signal outputted from the sound source unit 80, to generate a sound corresponding to the sound signal.

[4. Internal Structure of Housing 50]

Then, an internal structure of the housing 50, particularly, the frame 20 which supports the keys 10 and a reinforcement member 30 for suppressing deformation of the housing 50 will be described.

Figure 3:
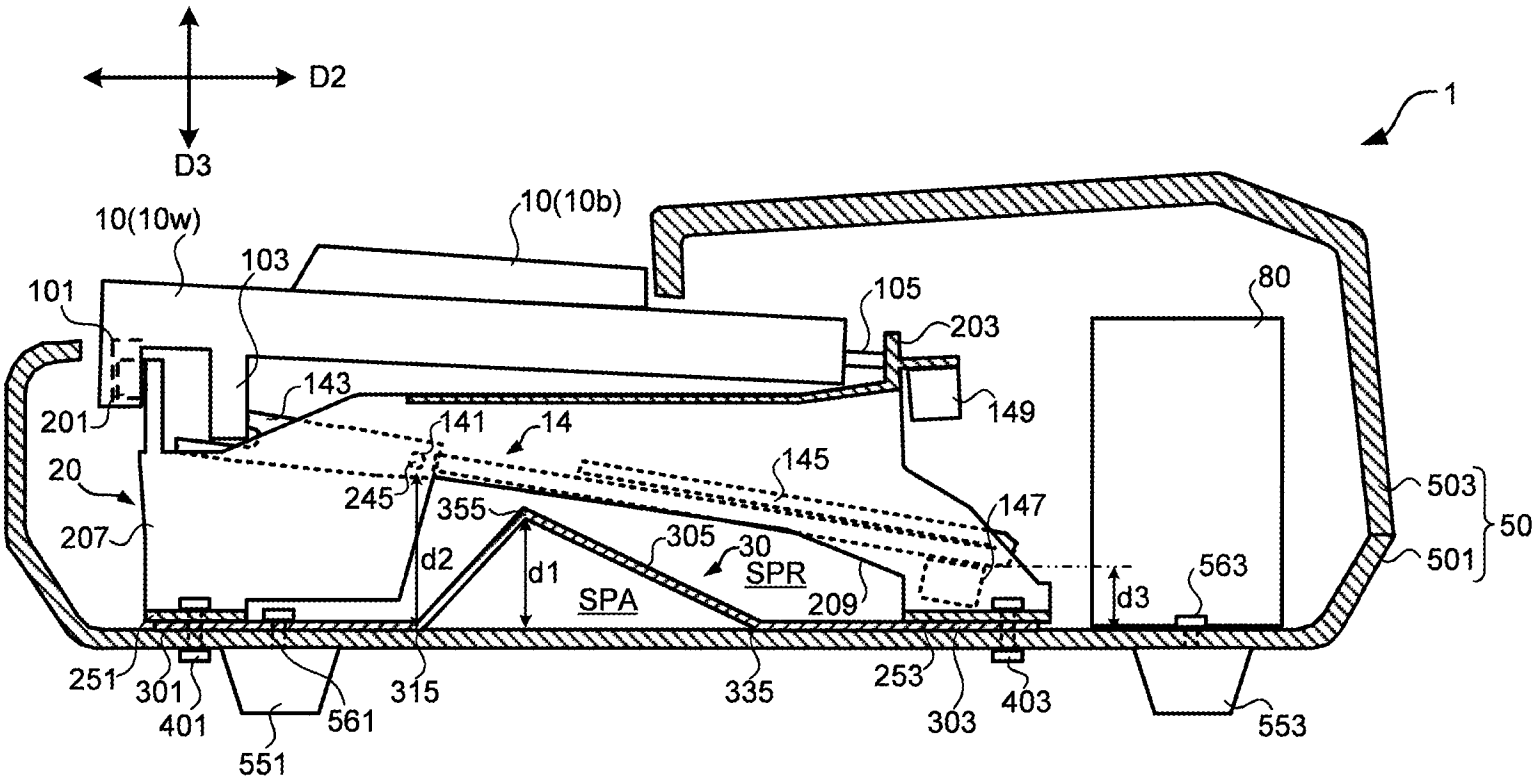
FIG. 3 is a diagram for describing an internal structure (in a case where keys are in a rest position) of the keyboard apparatus according to the first embodiment of the present invention.

FIG. 3 is a diagram for describing an internal structure (in a case where the keys 10 are in a rest position) of the keyboard apparatus 1 according to the first embodiment of the present invention. FIG. 3 is a diagram schematically illustrating a cross section in a case where the keyboard apparatus 1 is cut along a surface having the first direction D1 as its normal line. In FIG. 3, a configuration corresponding to the white key 10*w* among the keys 10 is illustrated, and a configuration, other than a position of the black key 10*b*, corresponding to the black key 10*b* is omitted.

The housing 50 (a first member) is a member as an exterior of the keyboard apparatus 1, includes a lower housing 501 and an upper housing 503, and further includes side plates (not illustrated) arranged at both ends of the keyboard apparatus 1 in the first direction D1. Although formed of a material containing aluminum as a main component, the lower housing 501 and the upper housing 503 may be formed of another material, e.g., a material containing iron as a main component or may be formed of a resin material.

Both the lower housing 501 and the upper housing 503 extend in the first direction D1. That is, both a longitudinal direction of the lower housing 501 and a longitudinal direction of the upper housing 503 are along the first direction D1. The lower housing 501 and the upper housing 503 may have the same cross-sectional shape at a plurality of different positions in the first direction D1, and need not have the same cross-sectional shape at all the positions.

The lower housing 501 includes a bottom portion having a surface including the first direction D1 and the second direction D2 (a surface having the third direction D3 as its normal line), and includes portions bent upward from the bottom portion at its front end and rear end. To the bottom portion of the lower housing 501, a front-side leg section 551 is attached with a fastener 561, and a rear-side leg section 553 is attached with a fastener 563. Each of the fasteners 561 and 563 includes a bolt and a nut. In this example, the fastener 561 penetrates the lower housing 501 and the reinforcement member 30, to not only fix the front-side leg section 551 and the rear-side leg section 553 to the lower housing 501 but also to fix a positional relationship between the lower housing 501 and the reinforcement member 30.

The upper housing 503 is connected to the rear end of the lower housing 501, and is arranged by extending forward from the rear end to cover the rear of the key 10 from above and expose the front of the key 10.

The frame 20, together with the reinforcement member 30, is fixed to the lower housing 501, and supports the plurality of keys 10 arranged in the first direction D1. The frame 20 is formed of a resin material in this example. The frame 20 includes a key guide section 201, a key support section 203, a rib section 207, a front-side bottom section 251, a rear-side bottom section 253, and a shaft section 245. The key guide section 201, the key support section 203, the shaft section 245, the front-side bottom section 251, and the rear-side bottom section 253 extend in the first direction D1. That is, all respective longitudinal directions of the components are along the first direction D1. The key guide section 201, the key support section 203, the front-side bottom section 251, the rear-side bottom section 253, and the shaft section 245 may have the same cross-sectional shape at a plurality of different positions in the first direction D1, and need not have the same cross-sectional shape at all the positions.

The rib section 207 is a plate-shaped member having a surface including the second direction D2 and the third direction D3 (a surface having the first direction D1 as its normal line). The plurality of rib sections 207 are arranged side by side in the first direction D1. Each of the plurality of rib sections 207 is connected to the key guide section 201, the key support section 203, the shaft section 245, the front-side bottom section 251, and the rear-side bottom section 253. In other words, respective ends of the components are connected between the adjacent rib sections 207.

In the rib section 207, a notch section 209 is formed on the side of the lower housing 501 between the front-side bottom section 251 and the rear-side bottom section 253. By the notch section 209, a region where the rib section 207 and the lower housing 501 are separated from each other, i.e., a region where the frame 20 does not exist is formed between the front-side bottom section 251 and the rear-side bottom section 253. This region may be hereinafter referred to as a separation region SPR.

The key guide section 201 includes a plate-shaped member which slides with respect to a groove section 101 arranged in a lower part at a front end of the key 10. The plate-shaped member has a surface having the first direction D1 as its normal line, to regulate movement in the first direction D1 of the key 10. The key supporting section 203 supports a flexible section 105 arranged at a rear end of the key 10. The flexible section 105 is deformed in the up-and-down direction so that the key 10 rotates around the key support section 203. At this time, the key 10 rotates with the first direction D1 used as an axis because the movement of the key 10 in the first direction D1 is regulated by the key guide section 201.

Each of the front-side bottom section 251 and the rear-side bottom section 253 is a plate-shaped member having a surface including the first direction D1 and the second direction D2 (a surface having the third direction D3 as its normal line). In this example, the front-side bottom section 251 and the rear-side bottom section 253 are fixed to the lower housing 501 via the reinforcement member 30. The front-side bottom section 251 is fixed to the lower housing 501 with a fastener 401 (a first through member). At this time, a part of the reinforcement member 30 is sandwiched between the front-side bottom section 251 and the lower housing 501. The rear-side bottom section 253 is fixed to the lower housing 501 with a fastener 403 (a third through member). At this time, a part of the reinforcement member 30 is sandwiched between the rear-side bottom section 253 and the lower housing 501.

In this example, each of the fasteners 401 and 403 includes a bolt and nut, and penetrates the frame 20 (the front-side bottom section 251 and the rear-side bottom section 253), the lower housing 501, and the reinforcement member 30, to also fix a positional relationship among the frame 20, the reinforcement member 30, and the lower housing 501. Details of the positional relationship will be described below.

The shaft section 245 is a rod-shaped member extending in the first direction D1, and slides with respect to the bearing 141 in the load section 14, to rotatably support the load section 14.

The load section 14 (a third member) is arranged to correspond to each of the keys 10, and includes the bearing 141, a key connection section 143, and a weight section 145. The key connection section 143 is arranged on the opposite side to the weight section 145 with respect to the bearing 141. The key connection section 143 slides with respect to a load driving section 103 provided in a lower part of the key 10. The load section 14 has a center of gravity existing on the side closer to the weight section 145 than the bearing 141. Accordingly, in the load section 14, when the key 10 is not pressed, the weight section 145 is placed on the lower stopper 147, to hold the key 10 at a rest position. Although movement of the load section 14 at the time when the key 10 is pressed will be described below (see FIG. 6), the upper stopper 149 regulates an upper-limit position of the weight section 145. The lower stopper 147 and the upper stopper 149 are supported on the frame 20.

The reinforcement member 30 (a second member) is a plate-shaped member including a material containing aluminum as a main component. The reinforcement member 30 extends in the first direction D1. That is, a longitudinal direction of the reinforcement member 30 is along the first direction D1. In this example, the lower housing 501 is larger than the reinforcement member 30 when they are compared with each other in terms of a length in the second direction D2. The reinforcement member 30 includes a first section 301, a second section 303, and a third section 305. Among the components, the first section 301, the third section 305, and the second section 303 are arranged in this order in the second direction D2. That is, the third section 305 is arranged between the first section 301 and the second section 303. The reinforcement member 30 may have the same cross-sectional shape at a plurality of different positions in the first direction D1, and need not have the same cross-sectional shape at all the positions. Although the reinforcement member 30 is preferably formed of a material having flexibility such as a metal from the viewpoint of such processability that it can be formed by bending the plate-shaped member, the reinforcement member 30 may be formed of another material.

Each of the first section 301 and the second section 303 is a plate-shaped member having a surface including the first direction D1 and the second direction D2 (a surface having the third direction D3 as its normal line), and contacts the lower housing 501. The first section 301 is sandwiched between the front-side bottom section 251 and the lower housing 501. The second section 303 is sandwiched between the rear-side bottom section 253 and the lower housing 501 at a position away from the first section 301. The third section 305 is a plate-shaped member away from the lower housing 501 between the first section 301 and the second section 303. In this example, the third section 305 includes a portion bent at a bending top section 355.

The reinforcement member 30 includes a portion bent between the first section 301 and the second section 303. In this example, the reinforcement member 30 includes a bending section 315 between the first section 301 and the third section 305, and includes a bending section 335 between the second section 303 and the third section 305. All the bending sections 315 and 335 and the bending top section 355 may each include a portion in a direction inclined with respect to the first direction D1, although preferably in the first direction D1. A space SPA surrounded by a part (the third section 305) of the reinforcement member 30 and the lower housing 501 is formed. The space SPA spreads in the first direction D1, and is arranged at a position where it passes through the separation region SPR.

The load section 14 rotates without contacting the third section 305 above the third section 305. In this example, to efficiently form the space SPA, a positional relationship is defined among the components, as described below. The bending top section 355 is arranged on the side closer to the weight section 145 than the bearing 141 (the shaft section 245) (on the rear end side). A distance d1 from the lower housing 501 to the bending top section 355 is smaller than a distance d2 from the lower housing 501 to the bearing 141, and is larger than a shortest distance d3 from the lower housing 501 to a rear end of the weight section 145. Although the distance from the lower housing 501 to the rear end of the weight section 145 changes depending on a rotation position of the load section 14, the shortest distance corresponds to a distance in a case where the key 10 is at a rest position (a position illustrated in FIG. 3) in this example. In other words, a rotation range of the load section 14 includes a portion at a distance shorter from the lower housing 501 than the distance d1 from the lower housing 501 to the bending top section 355 farthest away therefrom in the reinforcement member 30.

[5. Relationship Among Frame 20, Reinforcement Member 30, and Housing 50]

Then, a relationship among the frame 20, the reinforcement member 30, and the housing 50 (the lower housing 501) will be described in more detail with reference to FIGS. 4 and 5.

Figure 4:
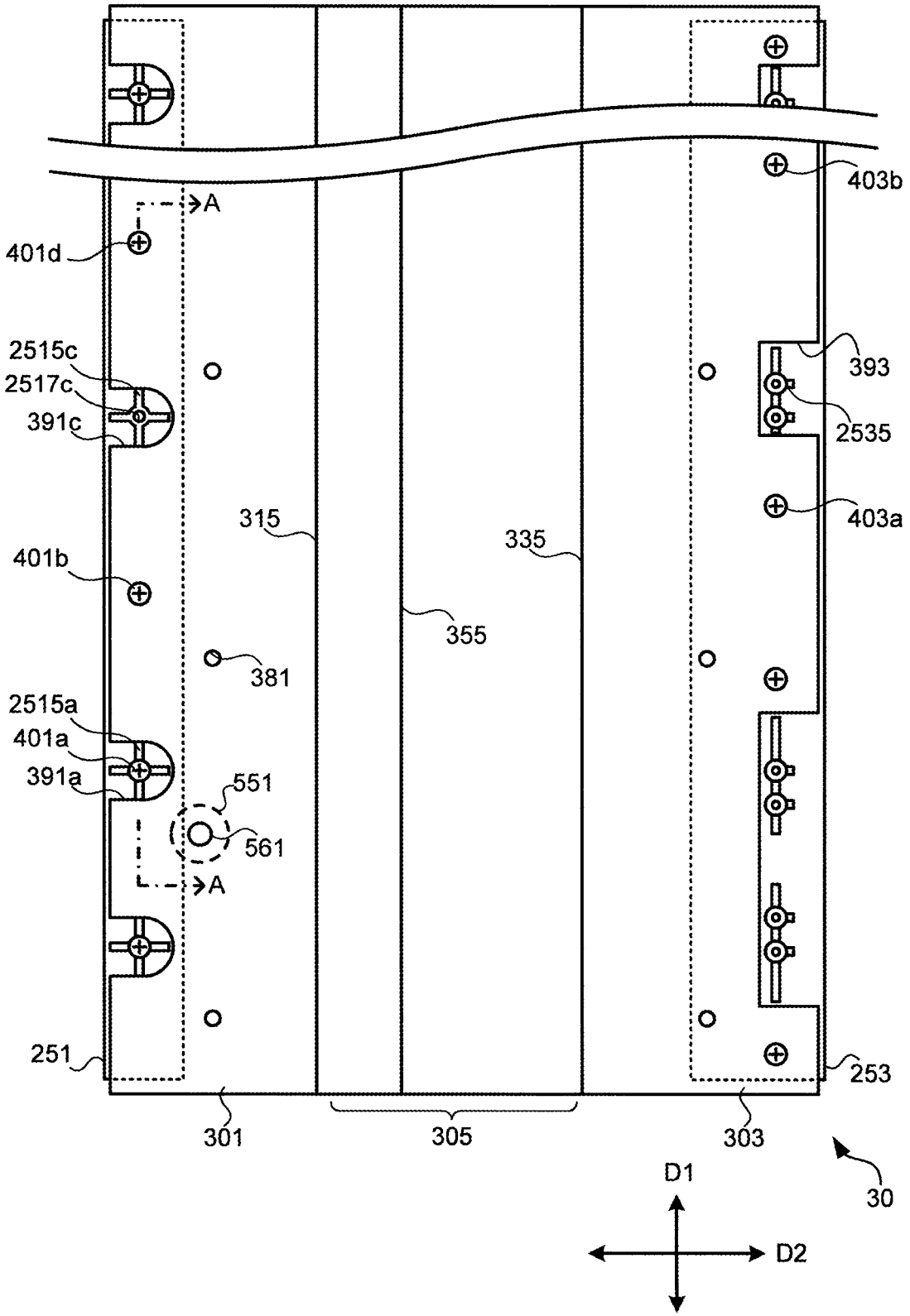
FIG. 4 is a diagram for describing a positional relationship between a reinforcement member and a frame in the first embodiment of the present invention.

FIG. 4 is a diagram illustrating a positional relationship between the reinforcement member 30 and the frame 20 in the first embodiment of the present invention. FIG. 4 is a diagram illustrating the reinforcement member 30 viewed from the side of the lower housing 501, from which the lower housing 501 is omitted. FIG. 5 is a schematic sectional view (a cross-sectional view along a line A-A in FIG. 4) illustrating a connection relationship among the lower housing 501, the reinforcement member 30, and the frame 20 in the first embodiment of the present invention.

Figure 5:
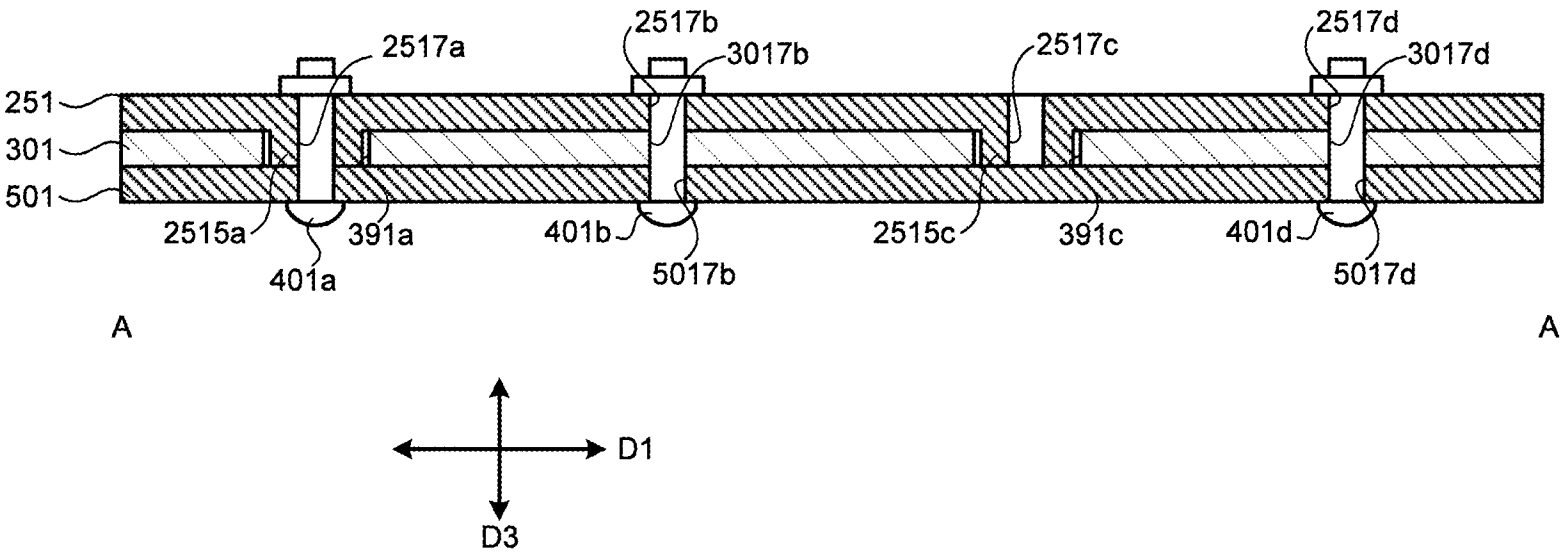
FIG. 5 is a schematic sectional view (a cross-sectional view along a line A-A in FIG. 4) illustrating a connection relationship among a lower housing, a reinforcement member, and a frame in the first embodiment of the present invention.

As illustrated in FIGS. 4 and 5, notch sections 391*a* and 391*c* are formed in the first section 301 in the reinforcement member 30. In a region where the reinforcement member 30 does not exist due to the notch section 391*a*, a protrusion section 2515*a* formed in the front-side bottom section 251 and protruding toward the lower housing 501 is arranged. The protrusion section 2515*a* is formed in a substantially cross shape including a portion extending in the first direction D1 and a portion extending in the second direction D2, and includes a through hole 2517*a* formed in its center. A distal end of the protrusion section 2515*a* contacts the lower housing 501. That is, the lower housing 501 may have a region which is not only connected to the frame 20 via the reinforcement member 30 but also contacts the frame 20. The through hole 2517*a* is arranged at the same position as that of a through hole 5017*a* formed in the lower housing 501. A fastener 401*a* includes a bolt and a nut, like the above-described fastener 401, and penetrates the front-side bottom section 251 and the lower housing 501 via the through hole 2517*a* and the through hole 5017*a*.

In a region where the reinforcement member 30 does not exist due to the notch section 391*c*, a protrusion section 2515*c* formed in the front-side bottom section 251 and protruding toward the lower housing 501 is arranged. The protrusion section 2515*c* is formed in a substantially cross shape including a portion extending in the first direction D1 and a portion extending in the second direction D2, and includes a through hole 2517*c* formed in its center. A distal end of the protrusion section 2515*c* contacts the lower housing 501. A fastener is not arranged in the through hole 2517*c*. Accordingly, the through hole 2517*c* is closed by the lower housing 501 in this example.

Both ends in the first direction D1 of each of the protrusion sections 2515*a* and 2515*c* contact the reinforcement member 30, or are slightly separated from the reinforcement member 30. This can also be used to define a positional relationship between the reinforcement member 30 and the frame 20 for the first direction D1. One end in the second direction D2 of each of the protrusion sections 2515*a* and 2515*c* may contact the reinforcement member 30, or may be slightly separated from the reinforcement member 30.

In the reinforcement member 30, the above-described notch section 391*c* is formed between a fastener 401*b* and a fastener 401*d*. That is, the protrusion section 2515*c* contacts the lower housing 501 between the fastener 401*b* (a first through member) and the fastener 401*d* (a second through member).

The fastener 401*b* has a similar structure to that of the fastener 401 illustrated in FIG. 3, and penetrates the front-side bottom section 251, the reinforcement member 30, and the lower housing 501 via a through hole 2517*b*, a through hole 3017*b*, and a through hole 5017*b*. The through hole 2517*b* is formed in the front-side bottom section 251, the through hole 3017*b* is formed in the reinforcement member 30, and the through hole 5017*b* is formed in the lower housing 501. The through holes 2517*b*, 3017*b*, and 5017*b* are respectively arranged at positions which are superimposed on one another as viewed in the third direction D3. The fastener 401*d* penetrates the front-side bottom section 251, the reinforcement member 30, and the lower housing 501, like the fastener 401*b*.

In this example, the first section 301 and the lower housing 501 are further coupled to each other via a coupling section 381. The coupling section 381 couples the first section 301 and the lower housing 501 to each other by burring caulking after the lower housing 501 is subjected to burring processing.

In this example, a notch section 393 is formed in the second section 303 in the reinforcement member 30, like in the first section 301. In a region where the reinforcement member 30 does not exist due to the notch section 393, a protrusion section 2535 formed in the rear-side bottom section 253 and protruding toward the lower housing 501 is formed. A distal end of the protrusion section 2535 contacts the lower housing 501.

In the reinforcement member 30, the above-described notch section 393 is formed between a fastener 403*a* and a fastener 403*b*. That is, the protrusion section 2535 contacts the lower housing 501 between the fastener 403*a* and the fastener 403*b*.

[6. Movement of Internal Structure of Housing 50]

Then, movement of an internal structure of the housing 50 when the key 10 is pressed will be described with reference to FIG. 3 and FIG. 6.

Figure 6:
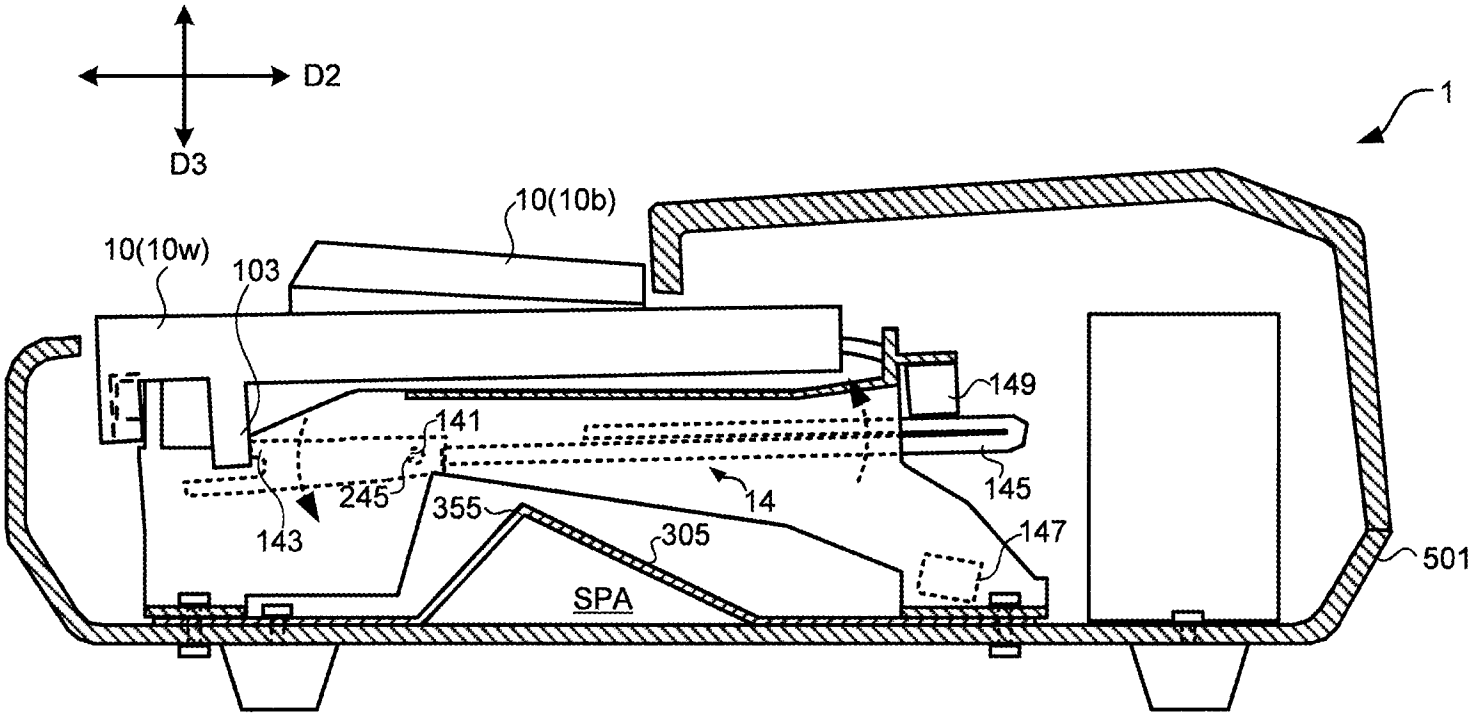
FIG. 6 is a diagram for describing an internal structure (in a case where keys are in an end position) of the keyboard apparatus according to the first embodiment of the present invention.

FIG. 6 is a diagram for describing an internal structure (in a case where the keys are in an end position) of the keyboard apparatus 1 according to the first embodiment of the present invention. When the key 10 is pressed in a state illustrated in FIG. 3, the load driving section 103 presses the key connection section 143. As a result, the weight section 145 is pressed up, and the load section 14 rotates around the shaft section 245 in conjunction with the key 10. At this time, the load section 14 applies the weight of the weight section 145 as a load to the key 10 via the key connection section 143 and the load driving section 103. The weight section 145 collides with the upper stopper 149 when it rises. As a result, the key 10 cannot be pressed, i.e., reaches the end position. Thus, the lower stopper 147 and the upper stopper 149 define respective rotation ranges of the key 10 and the load section 14.

The third section 305 in the reinforcement member 30 is arranged outside the rotation range of the load section 14 not to contact the load section 14. The bending top section 355 is arranged on the side closer to the weight section 145 than the bearing 141 (the shaft section 245) (on the rear end side), as described above, so that the bending top section 355 is arranged below the weight section 145. Accordingly, the weight section 145 rises by pressing the key 10, not to contact the bending top section 355. Although the key connection section 143 falls by pressing the key 10, the key connection section 143 may not contact the reinforcement member 30 at the end position.

Thus, the load section 14 rotates in conjunction with the key 10 without contacting the reinforcement member 30. In this example, the weight section 145 moves up and down above the third section 305. The above-described sensor in the key position detection unit 70 may be configured to detect the pressing position of the key 10 by detecting a position of the connection section 143 at the time when the key connection section 143 has fallen.

[7. Function]

As described above, in the reinforcement member 30, the first section 301 and the second section 303 are fixed to the lower housing 501, and the third section 305 arranged between the first section 301 and the second section 303 forms the space SPA. As a result, the lower housing 501 the longitudinal direction of which is the first direction D1 and the reinforcement member 30 function to suppress torsional deformation by each other. Further, when the first section 301 is arranged to be sandwiched between the front-side bottom section 251 in the frame 20 and the lower housing 501, the lower housing 501, the reinforcement member 30, and the frame 20 function to suppress torsional deformation by one another. In this example, the second section 303 is arranged to be sandwiched between the rear-side bottom section 253 in the frame 20 and the lower housing 501 so that the torsional deformation is further suppressed.

When an effect of suppressing the torsional deformation is thus enhanced, the rigidity of the entire keyboard apparatus 1 is increased even if the rigidity of the housing 50 alone is low so that the deformation of the keyboard apparatus 1 can be suppressed. Therefore, the housing 50 can be made lighter in weight by being formed of a lightweight material such as aluminum or thinned. The reinforcement member 30 is smaller than the housing 50, and can also be formed of a lightweight material. Thus, even if the weight of the keyboard apparatus 1 is increased because the reinforcement member 30 is added thereto, an effect of making the housing 50 lighter in weight is larger. Accordingly, the deformation of the keyboard apparatus 1 can be suppressed by increasing the rigidity of the entire keyboard apparatus 1 while suppressing the increase in the weight of the keyboard apparatus 1.

An electronic piano (stage piano) and an electronic keyboard for stage use have been strongly required to be lighter in weight while being required to improve in a feeling of rigidity when raised because they require portability. The keyboard apparatus 1 can be increased in rigidity while being made lighter in weight. Thus, an electronic piano being light in weight and having a high feeling of rigidity, for example, can be implemented. In the case, when the housing 50 is formed of a material having a good texture such as aluminum, an appearance of the electronic piano on a stage can also be improved. Further, even if a strong force is applied to a part of the keyboard apparatus 1 by pressing the keys 10 at the time of a performance, the deformation of the keyboard apparatus 1 is suppressed. Thus, a performance comfort is improved, and particularly a keying feeling is improved.

Second Embodiment

Although the frame 20, the reinforcement member 30, and the lower housing 501 may be fixed to one another with the fasteners in both the first section 301 and the second section 303 in the first embodiment, any one of the frame 20, the reinforcement member 30, and the lower housing 501 may not be fixed with the fasteners. An example of such a configuration will be described as a second embodiment.

Figure 7:
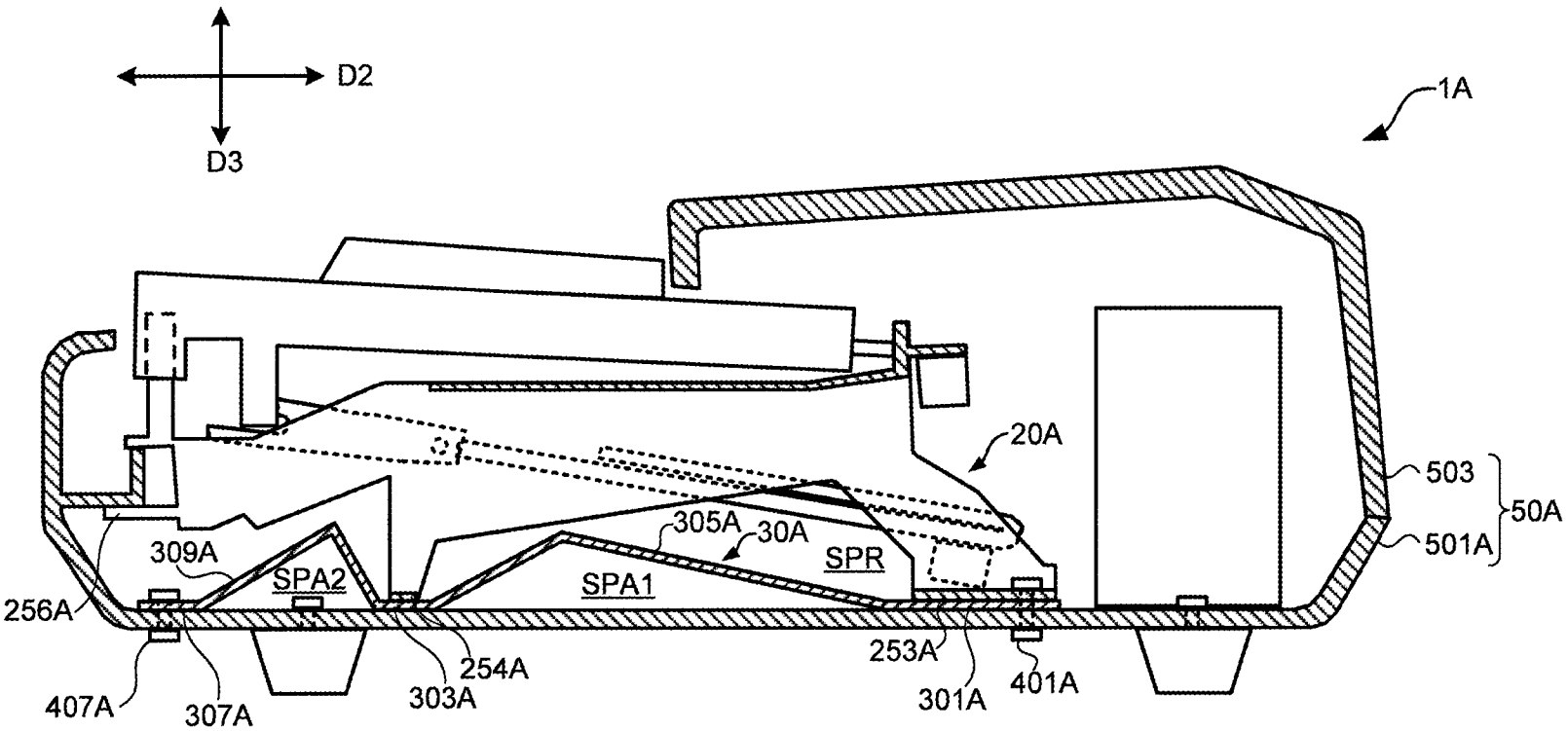
FIG. 7 is a diagram for describing an internal structure (in a case where keys are in a rest position) of a keyboard apparatus according to a second embodiment of the present invention.

FIG. 7 is a diagram for describing an internal structure (in a case where keys are in a rest position) of a keyboard apparatus 1A according to the second embodiment of the present invention. In the keyboard apparatus 1A according to the second embodiment, a reinforcement member 30A includes a first section 301A, a second section 303A, a third section 305A, a fourth section 307A, and a fifth section 309A. Among the components, the first section 301A, the third section 305A, the second section 303A, the fifth section 309A, and the fourth section 307A are arranged in this order in a second direction D2. Each of the first section 301A, the second section 303A, and the fourth section 307A is a plate-shaped member, and contacts a lower housing 501A.

The first section 301A is sandwiched between a rear-side bottom section 253A in a frame 20A and the lower housing 501A. A fastener 401A penetrates the rear-side bottom section 253A, the first section 301A, and the lower housing 501A. The fourth section 307A and the lower housing 501A are fixed to each other with a fastener 407A which penetrates the fourth section 307A and the the lower housing 501A. The fastener 407A includes a bolt and a nut, like the above-described fastener 401.

The second section 303A is sandwiched between a central bottom section 254A in the frame 20A and the lower housing 501A. The components contact each other, and are not fixed to each other with a fastener or the like. By a method for fixing the frame 20A to the housing 50A, such pressure that the second section 303A is pressed against the lower housing 501A may be received from the central bottom section 254A. For example, the frame 20A is fixed to the lower housing 501A in a front end section 256A. The fixing may be performed using a fastener including a bolt and a nut, or may be performed using an adhesive or the like. The frame 20A is fixed to the lower housing 501A in the front end section 256A and the rear-side bottom section 253A so that the central bottom section 254A may be arranged to press the second section 303A toward the lower housing 501A.

The third section 305A is a plate-shaped member away from the lower housing 501A between the first section 301A and the second section 303A. The fifth section 309A is a plate-shaped member away from the lower housing 501A between the second section 303A and the fourth section 307A. Accordingly, in the second embodiment, a space SPA1 surrounded by the third section 305A and the lower housing 501A is formed and a space SPA2 surrounded by the fifth section 309A and the lower housing 501A is formed. A plurality of spaces are formed between the reinforcement member 30A and the lower housing 501A to further increase the rigidity of the keyboard apparatus 1A so that deformation of the keyboard apparatus 1A can be suppressed.

Third Embodiment

In the first embodiment, the reinforcement member 30 is arranged as a structure separate from the housing 50 as an exterior member within the housing 50. In a third embodiment, an example in which a part of a housing 50B is made to have a function of the reinforcement member 30 and a decorative board is used as an exterior member will be described.

Figure 8:
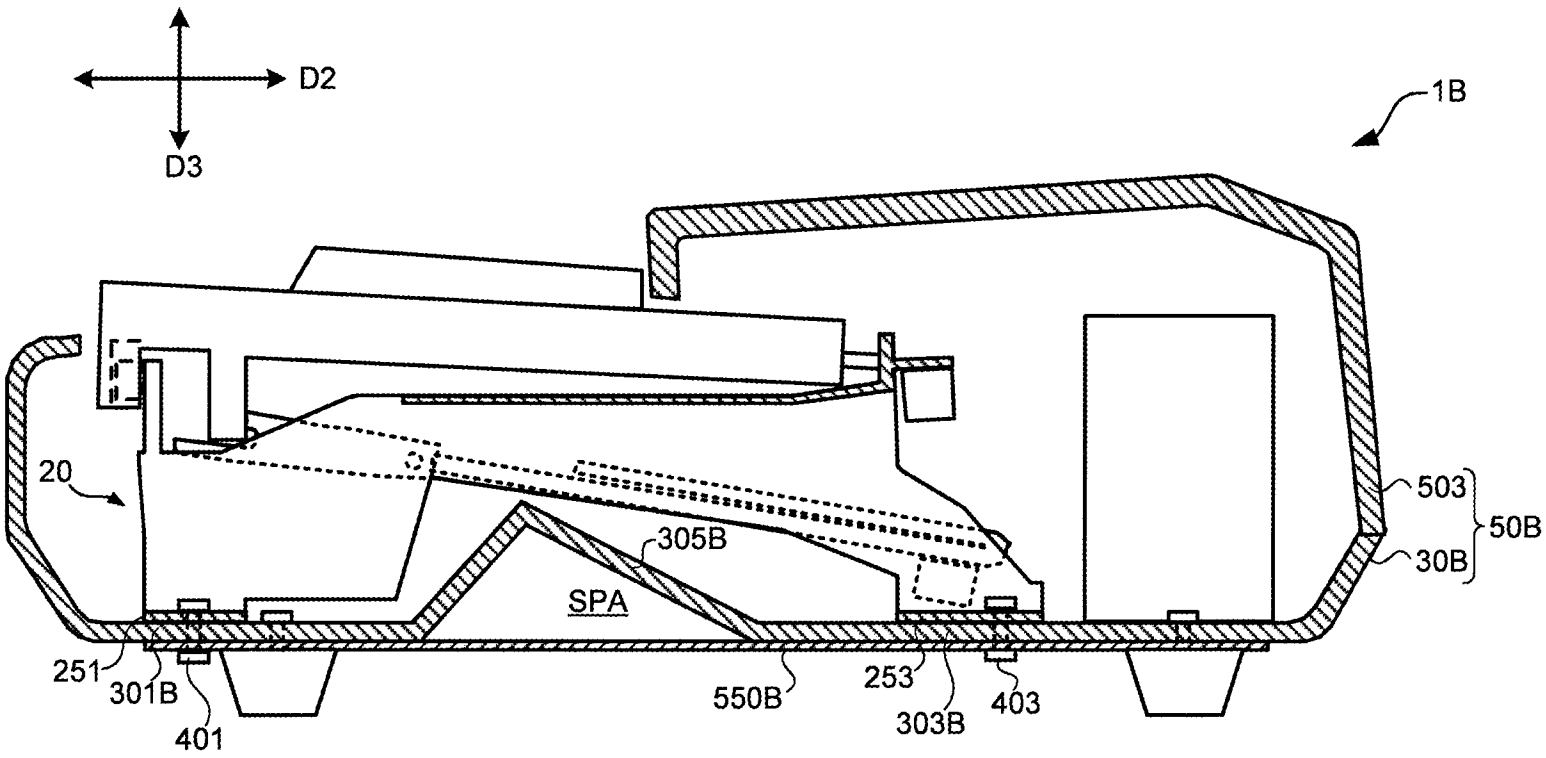
FIG. 8 is a diagram for describing an internal structure (in a case where keys are in a rest position) of a keyboard apparatus according to a third embodiment of the present invention.

FIG. 8 is a diagram for describing an internal structure (in a case where keys are in a rest position) of a keyboard apparatus 1B according to the third embodiment of the present invention. In the keyboard apparatus 1B according to the third embodiment, a lower housing connected to an upper housing 503 is formed as a reinforcement member 30B (a second member) in a housing 50B. A decorative board 550B (a first member) is arranged outside the reinforcement member 30B. In this example, the decorative board 550B is smaller than the reinforcement member 30B when they are compared with each other in terms of a length in a second direction D2. The reinforcement member 30B includes a first section 301B, a second section 303B, and a third section 305B. The third section 305B is arranged between the first section 301B and the second section 303B.

The first section 301B is sandwiched between a front-side bottom section 251 in a frame 20 and the decorative board 550B. The front-side bottom section 251, the first section 301B, and the decorative board 550B are fixed to one another with a fastener 401 which penetrates the front-side bottom section 251, the first section 301B, and the decorative board 550B. The second section 303B is sandwiched between a rear-side bottom section 253 in the frame 20 and the decorative board 550B. The rear-side bottom section 253, the second section 303B, and the decorative board 550B are fixed to one another with a fastener 403 which penetrates the rear-side bottom section 253, the second section 303B, and the decorative board 550B. The first section 301B is sandwiched between the front-side bottom section 251 in the frame 20 and the decorative board 550B while a space SPA surrounded by the third section 305B and the decorative board 550B is formed to increase the rigidity of the keyboard apparatus 1B so that deformation of the keyboard apparatus 1B can be suppressed.

Fourth Embodiment

In a fourth embodiment, an example in which a reinforcement member is also further attached to the upper housing in the configuration in the first embodiment will be described.

Figure 9:
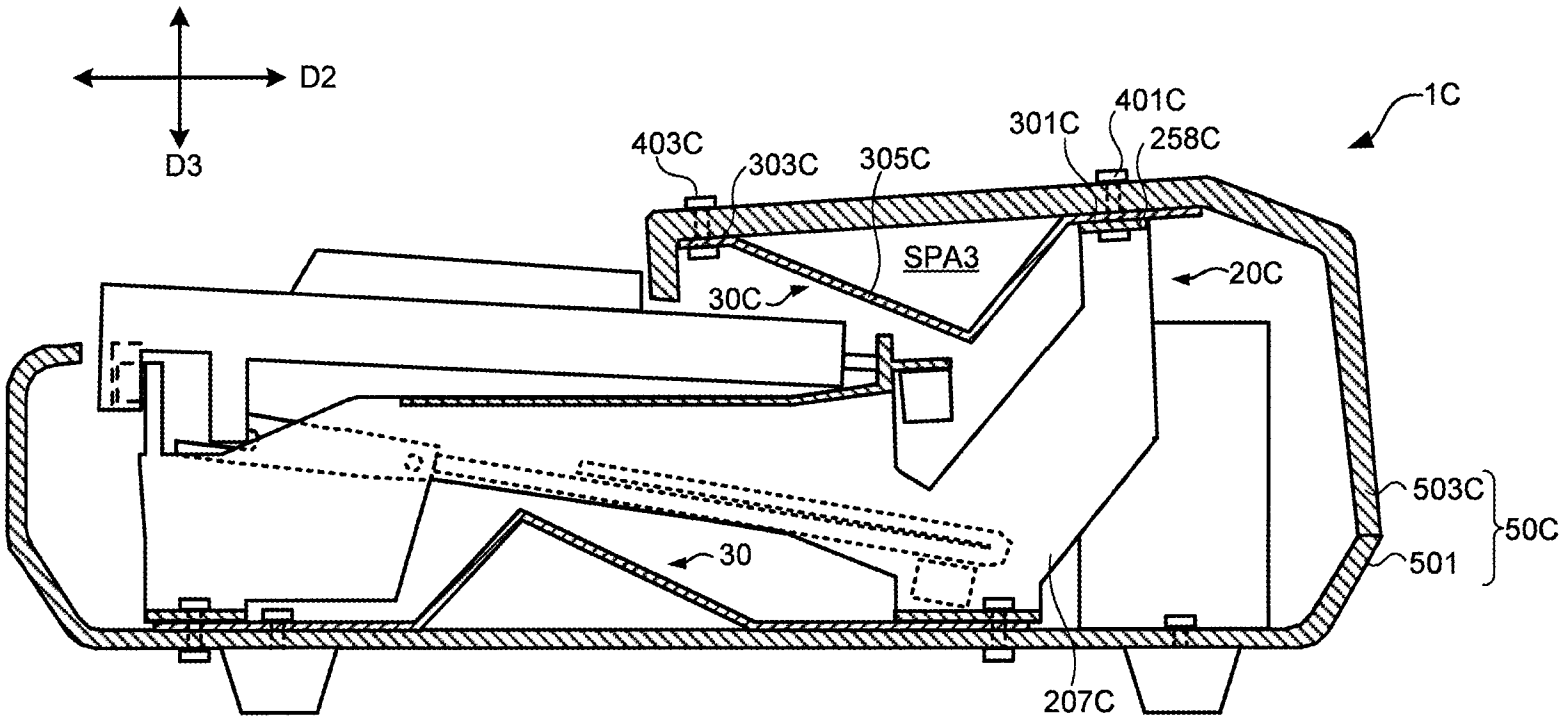
FIG. 9 is a diagram for describing an internal structure (in a case where keys are in a rest position) of a keyboard apparatus according to a fourth embodiment of the present invention.

FIG. 9 is a diagram for describing an internal structure (in a case where keys are in a rest position) of a keyboard apparatus 10 according to the fourth embodiment of the present invention. In the keyboard apparatus 10 according to the fourth embodiment, a reinforcement member 30C is also attached to an upper housing 503C in a housing 50C. The reinforcement member 30C includes a first section 301C, a second section 303C, and a third section 305C. The third section 305C is arranged between the first section 301C and the second section 303C.

The first section 301C is sandwiched between an upper section 258C in a frame 20C and the upper housing 503C. The upper section 258C is a plate-shaped member extending in a first direction D1, and is connected to a rib section 207C. The upper section 258C, the first section 301C, and the upper housing 503C are fixed to one another with a fastener 401C which penetrates the upper section 258C, the first section 301C, and the upper housing 503C. The second section 303C and the upper housing 503C are fixed to each other with a fastener 403C which penetrates the second section 303C and the upper housing 503C. Each of the fasteners 401C and 403C includes a bolt and a nut, like the fastener 401. The first section 301C is sandwiched between the upper section 258C in the frame 20C and the upper housing 503C while a space SPA3 surrounded by the third section 305C and the upper housing 503C is formed to increase the rigidity of the keyboard apparatus 10 so that deformation of the keyboard apparatus 10 can be suppressed. In this example, a reinforcement member 30 may not be provided within the housing 50C.

<Modifications>

Although the embodiments of the present invention have been described above, each of the embodiments of the present invention can also be modified to various forms as described below. The above-described embodiment and modifications described below can also be applied in combination with each other. Further, the components in each of the embodiments can be changed by adding other components, deleting some of the components, or replacing some of the components. Although an example in which the first embodiment is modified is described below, the present invention is also applicable as an example in which the other embodiment is modified.

(1) Although configured by combining two planes in the first embodiment, the third section 305 may be configured by combining more planes. In this case, the third section 305 may include not only one bending section (the bending top section 355) but also a plurality of bending sections. Any one of the bending sections is preferably in the first direction D1.

(2) Although configured by combining two planes in the first embodiment, the third section 305 may be configured by a curved surface or may be configured by combining a curved surface and a plane.

(3) Instead of a bolt and a nut in the first embodiment, each of the fasteners 401 and 403 may be another member such as a rivet as long as the member can penetrate and fix to one another the lower housing 501, the reinforcement member 30, and the frame 20.

(4) To fix the lower housing 501, the reinforcement member 30, and the frame 20 to one another, instead of the members that penetrates the components, such as the fasteners 401 and 403, in the first embodiment, a member which not penetrates but fixes to one another the lower housing 501, the reinforcement member 30, the frame 20, for example, an adhesive tape or an adhesive may be used.

(5) Another member may be sandwiched between the components which contact each other in the first embodiment. Although directly connected to each other, respective portions of the lower housing 501 and the reinforcement member 30 which contact each other may be indirectly connected to each other with another member sandwiched therebetween. Even if indirectly connected to each other, the components are preferably arranged to oppose each other.

(6) Although respectively plate-shaped members having the same thickness in the first embodiment, all the first section 301, the second section 303, and the third section 305 in the reinforcement member 30 may be different in thickness. Each of the sections may not have a uniform thickness. For example, a part of the third section 305 may be thicker than the other part.

(7) Although the first section 301 and the second section 303 are sandwiched between the frame 20 and the lower housing 501 in the first embodiment, either one of the first section 301 and the second section 303 may not be sandwiched as long as both the sections are connected to the lower housing 501. In a case where the second section 303 is not sandwiched between the frame 20 and the lower housing 501, for example, the second section 303 may not be connected to the frame 20 as long as it is connected to the lower housing 501.

(8) Although the keyboard apparatus 1 according to the first embodiment includes the speaker 60, the keyboard apparatus 1 may not include the speaker 60. In this case, the keyboard apparatus 1 may include a terminal which outputs a sound signal generated in the sound source unit 80. The keyboard apparatus 1 may not include the sound source unit 80. In this case, the keyboard apparatus 1 may include a terminal which outputs a signal depending on a detection result of the key position detection unit 70.

(9) The keyboard apparatus 1 according to the first embodiment may not include the load section 14. The keyboard apparatus 1 may include at least the keys 10, the frame 20, the reinforcement member 30, and the housing 50.

REFERENCE SIGNS LIST

1, 1A, 1B, 10: keyboard apparatus, 10: key, 10*b*: black key, 10*w*: white key, 14: load section, 20, 20A, 20C: frame, 30, 30A, 30B, 30C: reinforcement member, 50, 50A, 50B, 50C: housing, 60: speaker, 70: key position detection unit, 80: sound source unit, 90: operation unit, 101: groove section, 103: load driving section, 105: flexible section, 141: bearing, 143: key connection section, 145: weight section, 147: lower stopper, 149: upper stopper, 201: key guide section, 203: key support section, 207, 207C: rib section, 209: notch section, 245: shaft section, 251: front-side bottom section, 253, 253A: rear-side bottom section, 254A: central bottom section, 256A: front end section, 258C: upper section, 301, 301A, 301B, 301C: first section, 303, 303A, 303B, 303C: second section, 305, 305A, 305B, 305C: third section, 315: bending section, 335: bending section, 355: bending top section, 381: coupling section, 391*a*, 391*c*, 393: notch section, 401, 401*a*, 401A, 401*b*, 401C, 401*d*, 403, 403*a*, 403*b*, 403C, 407A: fastener, 501, 501A: lower housing, 503, 503C: upper housing, 550B: decorative board, 551: front-side leg section, 553: rear-side leg section, 561, 563: fastener, 800: sound producing function, 2515*a*, 2515*c*: protrusion section, 2517*a*, 2517*b*, 2517*c*, 3017*b*, 5017*a*, 5017*b*: through hole, 2535: protrusion section

What is claimed is:

1. A keyboard apparatus comprising:

a plurality of keys;

a frame supporting the plurality of keys arranged in a first direction;

a first member, a longitudinal direction of the first member being along the first direction; and a second member including a first section, a second section, and a third section, the first section, the third section, and the second section being arranged in this order in a second direction perpendicular to the first direction, the first section being a plate-shaped member sandwiched between the first member and the frame, the second section being connected to the first member at a position away from the first section, the third section being separated from the first member between the first section and the second section, and a longitudinal direction of the second member being along the first direction.

2. The keyboard apparatus according to claim 1, further comprising a first through member penetrating the frame, the first section, and the first member.

3. The keyboard apparatus according to claim 2, further comprising a second through member penetrating the frame, the first section, and the first member, wherein the first member contacts the frame between the first through member and the second through member.

4. The keyboard apparatus according to claim 1, wherein the first member includes a contact region with the frame.

5. The keyboard apparatus according to claim 1, wherein a length of the first member in the second direction is larger than a length of the second member in the second direction.

6. The keyboard apparatus according to claim 1, wherein the second member is a plate-shaped member, and the second member is bent between the first section and the second section so that the third section is separated from the first member.

7. The keyboard apparatus according to claim 1, wherein each key of the plurality of keys comprises a third member supported on the frame, and the third member includes a portion being configured to move in conjunction with the corresponding key without contacting the third section above the third section.

8. The keyboard apparatus according to claim 1, further comprising a third through member penetrating the frame, the second section, and the first member, wherein the second section is a plate-shaped section sandwiched between the first member and the frame.

9. The keyboard apparatus according to claim 1, wherein the first member includes a lower housing arranged below the plurality of keys and an upper housing arranged above the plurality of keys, and the first section is sandwiched between the lower housing and the frame.

* * * * *